US009290305B2

(12) United States Patent
Stefanek et al.

(10) Patent No.: US 9,290,305 B2
(45) Date of Patent: Mar. 22, 2016

(54) CHEMICAL, BIOLOGICAL, AND RADIOLOGICAL CONTAINMENT BAG

(71) Applicants: George Stefanek, Beverly Shores, IN (US); Pete Jenkner, Downers Grove, IL (US); James Gauger, Highland Park, IL (US)

(72) Inventors: George Stefanek, Beverly Shores, IN (US); Pete Jenkner, Downers Grove, IL (US); James Gauger, Highland Park, IL (US)

(73) Assignee: ISOVAC PRODUCTS LLC, Romeoville, IL (US)

( * ) Notice: Subject to any disclaimer, the term of this patent is extended or adjusted under 35 U.S.C. 154(b) by 11 days.

(21) Appl. No.: 14/288,066

(22) Filed: May 27, 2014

(65) Prior Publication Data

US 2015/0067999 A1 Mar. 12, 2015

Related U.S. Application Data

(63) Continuation of application No. 12/237,119, filed on Sep. 24, 2008, now abandoned.

(60) Provisional application No. 60/995,049, filed on Sep. 24, 2007.

(51) Int. Cl.
*A62B 31/00* (2006.01)
*A62B 17/00* (2006.01)
(Continued)

(52) U.S. Cl.
CPC ..... *B65D 37/00* (2013.01); *A41D 27/245* (2013.01); *A44B 19/32* (2013.01); *A61G 10/005* (2013.01); *A61G 17/06* (2013.01); *B65D 51/1616* (2013.01); *B65D 81/18* (2013.01); *B65D 81/266* (2013.01); *B65D 88/22* (2013.01)

(58) Field of Classification Search
CPC ..... A61G 10/005
USPC ..... 600/21
See application file for complete search history.

(56) References Cited

U.S. PATENT DOCUMENTS 3,628,640 A 12/1971 Molnar
4,780,940 A 11/1988 Jay
(Continued)

FOREIGN PATENT DOCUMENTS

JP 2003-190233 A 7/2003
JP 2006-116069 A 5/2006
(Continued)

*Primary Examiner* — Catherine B Kuhlman
*Assistant Examiner* — Shannon McBride
(74) *Attorney, Agent, or Firm* — Pauley Erickson & Kottis

(57) ABSTRACT

An isolation apparatus for transporting and storing objects or human remains. The apparatus is formed of a flexible, foldable, opaque, generally box-like enclosure fabricated of a fiber reinforced plastic film, and welded together to form a sealed, air-tight and/or liquid-tight enclosure. A gas and liquid sealing zipper is positioned along three of four sides of the enclosure, thereby allowing the apparatus to open in a clamshell or suitcase-like manner, for easy access to the interior of the enclosure. An NBC and/or a CBRN filter can be mounted to the apparatus to allow for release of pressure from within the enclosure. An interior liner made of chemical protective fabric can be placed within the enclosure for additional chemical containment. This apparatus eliminates or significantly reduces the size and number of cracks, crevices and/or other voids into which contaminated materials can enter, for example by positioning, sizing and/or structuring welds to extend completely to an edge of the isolation apparatus, and/or by welding materials together entirely around one or more peripheries.

20 Claims, 9 Drawing Sheets

(51) Int. Cl.

| | |
|---|---|
| ***B65D 37/00*** | (2006.01) |
| ***A61G 10/00*** | (2006.01) |
| ***A41D 27/24*** | (2006.01) |
| ***A44B 19/32*** | (2006.01) |
| ***B65D 51/16*** | (2006.01) |
| ***B65D 81/26*** | (2006.01) |
| ***A61G 17/06*** | (2006.01) |
| ***B65D 81/18*** | (2006.01) |
| ***B65D 88/22*** | (2006.01) |

(56) References Cited

U.S. PATENT DOCUMENTS

| | | | | |
|---|---|---|---|---|
| 4,790,051 | A | 12/1988 | Knight | |
| 4,872,220 | A | 10/1989 | Haruvy et al. | |
| 4,922,562 | A | 5/1990 | Allred et al. | |
| 5,061,235 | A | 10/1991 | Hogan | |
| 5,659,933 | A | 8/1997 | McWilliams | |
| 5,715,583 | A | 2/1998 | Sandoval | |
| 6,241,653 | B1 | 6/2001 | Gauger et al. | |
| 6,321,764 | B1 | 11/2001 | Gauger et al. | |
| 6,969,346 | B2 | 11/2005 | Perlatti | |
| 6,971,985 | B2 | 12/2005 | Perlatti | |
| 6,976,293 | B2 * | 12/2005 | Traulle et al. | 24/436 |
| 6,997,483 | B2 | 2/2006 | Perlatti | |
| 7,196,023 | B2 | 3/2007 | Langley et al. | |
| 7,228,603 | B2 | 6/2007 | Craig | |
| 7,237,672 | B1 | 7/2007 | Governale et al. | |
| 7,246,415 | B2 | 7/2007 | Takatori et al. | |
| 7,479,103 | B2 | 1/2009 | Ellen | |
| 2004/0111008 | A1 | 6/2004 | Perlatti | |
| 2005/0191918 | A1 | 9/2005 | Langley et al. | |
| 2006/0191930 | A1 * | 8/2006 | Godano | 220/9.2 |
| 2007/0056593 | A1 | 3/2007 | Kubiesko et al. | |
| 2009/0080811 | A1 | 3/2009 | Stefanek et al. | |

FOREIGN PATENT DOCUMENTS

| | | | |
|---|---|---|---|
| KR | 20-1987-0000013 | Y1 | 1/1987 |
| KR | 20-0373755 | Y1 | 1/2005 |

* cited by examiner

CHEMICAL, BIOLOGICAL, AND RADIOLOGICAL CONTAINMENT BAG

CROSS REFERENCE TO RELATED APPLICATION

This application is a continuation of U.S. Ser. No. 12/237,119, which claims the benefit of U.S. Provisional Application Ser. No. 60/995,049, filed on 24 Sep. 2007. The provisional application is hereby incorporated by reference herein in its entirety and is made a part hereof, including but not limited to those portions which specifically appear hereinafter.

BACKGROUND OF THE INVENTION

This invention relates generally to an isolation apparatus for the storage and transport of remains or equipment contaminated by chemical, biological, and/or radiological agents. The isolation apparatus has a size to accommodate and transport a contaminated body.

Governments and armed forces are increasingly concerned over the potential for the use of chemical or biological weapons in terrorist attacks or in warfare. There is also fear of outbreak from biological agents such as SARS, avian flu, and other biological agents. The use of chemical or biological weapons creates special concerns for transport, especially as second-tier personnel do not typically have adequate protective suits, training, and/or facilities for handling contaminated remains and equipment. To avoid contamination of such personnel, transport assets, and other facilities, it is necessary to isolate contaminated remains and/or critical equipment during transport or storage.

Isolation of the contaminated remains or equipment is required to prevent contamination to first responders and care-givers, transport and other personnel, and transport assets and equipment. Storage and/or transport of contaminated remains or equipment may be necessary for several reasons. Biologically contaminated remains cannot usually be decontaminated by any method short of cremation. Decontamination of biologically contaminated equipment may be difficult and/or not readily available. Chemical or radiological decontamination of remains and equipment may be difficult, not immediately possible, too large in scope, or not possible without transport to a decontamination center.

There is a need for an improved containment device suitable for handling contaminated remains or equipment in the field and for transporting the remains or equipment to a decontamination facility.

SUMMARY OF THE INVENTION

This invention is an apparatus for isolating individual remains or equipment contaminated by chemical, biological, and/or radiological incidents, and having the ability to transport those remains or equipment while maintaining isolation and containment.

The general object of the invention can be attained, at least in part, through an isolation apparatus for transporting a contaminated object or person. The isolation apparatus includes an enclosure formed of a plurality of flexible panels that define a transport chamber for receiving the contaminated object or person. The enclosure can be foldable into a collapsed form having a significantly reduced length or footprint and can have a cross-section no larger than that of the expanded generally rectangular box-like enclosure. The enclosure has a closable opening that provides access to the transport chamber, and a gas tight and/or liquid tight fastener for closing the closable opening. An interior liner can be disposed within the transport chamber. The interior liner can be formed at least in part from a chemical protective fabric for forming a chemical protective barrier between the contaminated object or person and at least a portion of the enclosure.

The apparatus according to a preferred embodiment of this invention comprises an exterior opaque, flexible, generally rectangular box-like enclosure or shell, having a bottom panel, a side wall, and a top panel. The side wall is secured to the bottom panel and the top panel with a gas and liquid tight seal or weld. A gas tight and/or liquid tight fastener, e.g., a zipper or other slider assembly, is secured to the side wall over or within the closable opening on three sides, thereby allowing the enclosure to open in a suitcase-like fashion. Alternative configurations are also contemplated, such a straight line side or top zipper and a two-dimensional design (i.e., no side wall).

The bottom panel is secured to at least one pair of lateral reinforcing straps. Each of these one or more pairs of lateral reinforcing straps is connected at the ends to form loops. The loops can serve as handholds, through which persons may grasp the containment bag and lift and transport it to another site.

The isolation apparatus desirably includes a Chemical/Biological/Radiological/Nuclear (CBRN) filter and/or a Nuclear/Biological/Chemical (NBC) filter mounted to the side wall of the apparatus. The filter can release pressure from within the bag that may result, for example, from decomposition gas buildup or from aircraft decompression, while blocking or preventing the escape of the contaminating agent. The location of the filter on the side wall at the foot end of the apparatus is desirable, so that the filter neither gets wet from bodily fluids nor contacts the head of the remains.

The isolation apparatus desirably includes a chemical protective fabric liner that is chemical adsorptive, absorptive, and/or includes carbon sphere technology or activated charcoal, fastened, such as secured by hook-loop fasteners, on the bottom panel, the side wall and the top panel. When remains or equipment are stored in the apparatus, the top portion of the liner is detached from the shell and used to shroud the remains or equipment. On the interior of the bottom panel of the liner an absorbent mat can be attached to absorb bodily fluids.

When remains or equipment are placed into the isolation apparatus, the exterior of the apparatus can easily be decontaminated because of the construction of the apparatus. The welded seams and connections of this invention eliminate or significantly reduce the size and number of cracks, crevices and/or other voids into which contaminated materials can enter, for example by positioning, sizing and/or structuring welds to extend completely to an edge of the isolation apparatus, and/or by welding materials (such as the reinforcing straps) together entirely around one or more peripheries. Alternative construction means include sewing of materials and sealing of the seams with a heat tape or other suitable means.

As used herein, references to "weld" or "welded" is intended to relate to any suitable weld, adhesive, seal and/or other apparatus or device or method that provides a gas tight and/or liquid tight seal between two or more materials.

Further, references herein to "a plurality" are to be understood to refer to more than one.

Other objects and advantages will be apparent to those skilled in the art from the following detailed description taken in conjunction with the appended claims and drawings.

Particular layers in the sectional views may not include crosshatching for clarity in the illustration of welds according to this invention.

DETAILED DESCRIPTION OF THE DRAWINGS

The present invention provides an isolation apparatus, such as a containment bag, for isolating remains and/or other objects that have been exposed to chemical, biological, and/or radiological agents. The apparatus can be used for transporting these contaminated remains or objects. Transportation is generally necessary to move such remains to decontamination facilities or safe, isolated storage locations. Isolation of the remains and/or objects is necessary either to protect the transporter, the caregiver, or the unprotected personnel against dangerous exposure to these same chemical, biological, and/or radiological agents.

This invention may take many different forms. The drawings and the description of this invention detail currently preferred embodiments of this invention. It should be understood that the present disclosure is to be considered as but an example of the principles of this invention. The present disclosure is not intended to limit the broad aspect of this invention to the embodiments illustrated.

Figure 7A:
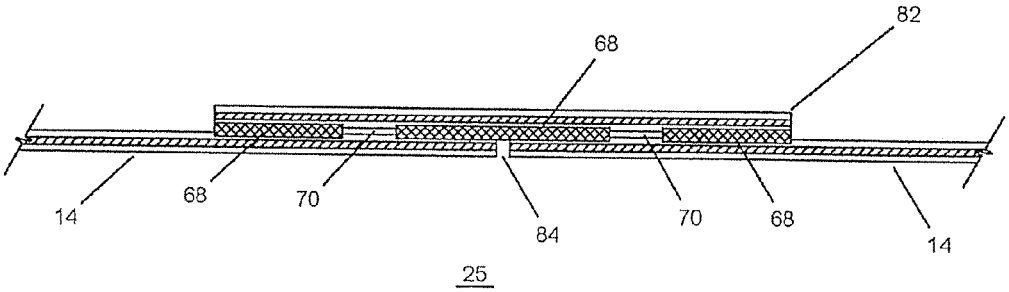
FIGS. 7A-B show a side wall seam according to one embodiment of this invention.
Figure 7B:
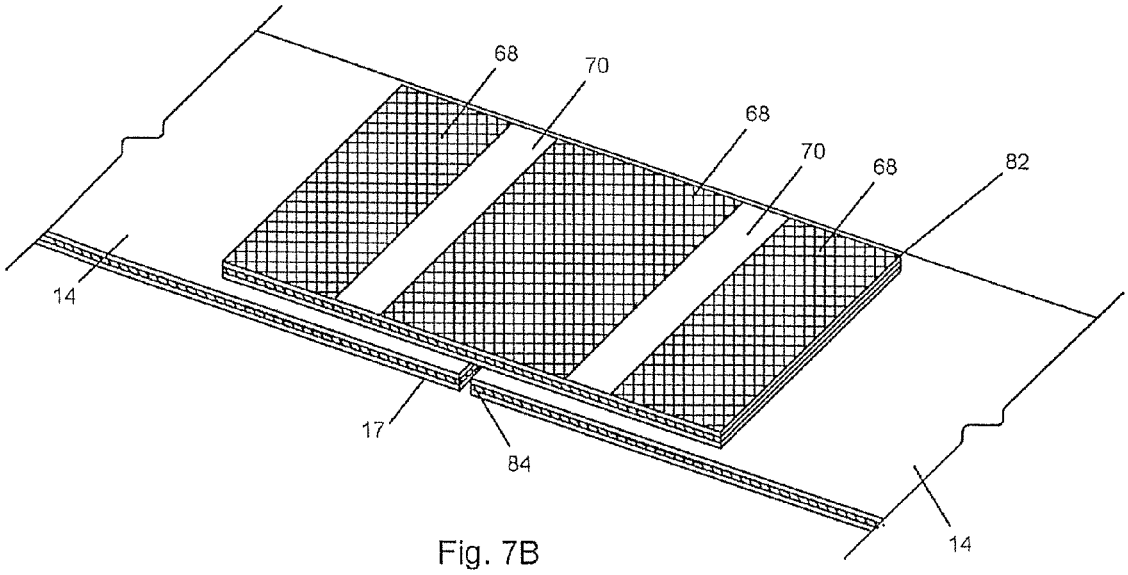

FIGS. 1-4 illustrate an enclosure 12 for an isolation apparatus 10 according to one embodiment of this invention. The enclosure 12 is desirably formed of a plurality of flexible panels to provide a flexible, generally rectangular box-like enclosure 12, which is preferably but not necessarily opaque. The enclosure 12 includes a bottom panel 24, a side panel 14, and a top panel 22. In FIGS. 1-4, the side panel 14 is formed from a single piece of flexible material that has the opposing ends welded together, such as by a weld discussed below with reference to FIGS. 7A-B. A bottom end 15 of the side panel 14 is welded about a periphery of the bottom panel 24. The top panel 22 is welded to a top end 17 of the side panel 14 about a periphery of the top panel 22.

Figure 1:
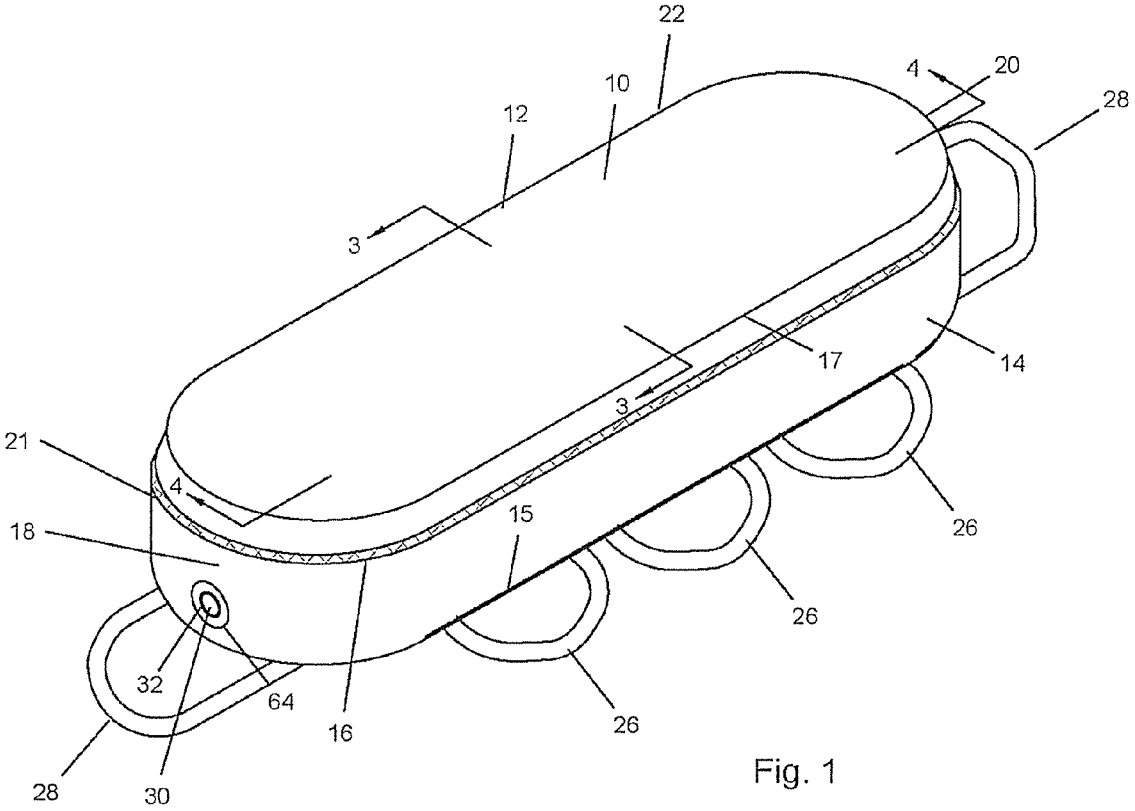
FIG. 1 is a perspective view of the apparatus of this invention, in an unfolded, zippered closed, ready-to-use extended state.
Figure 2:
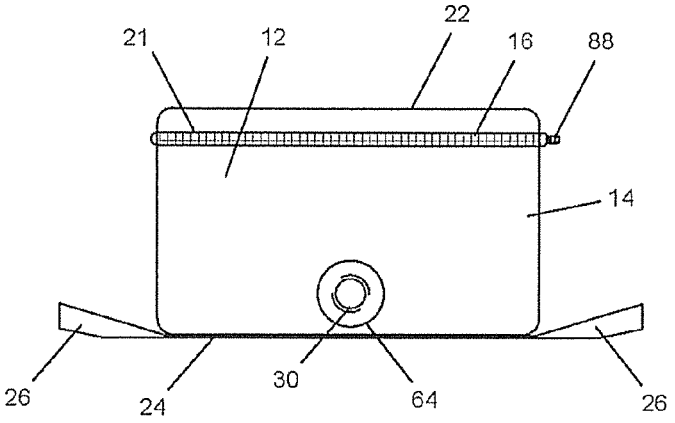
FIG. 2 is an end view of the apparatus of FIG. 1.
Figure 3:
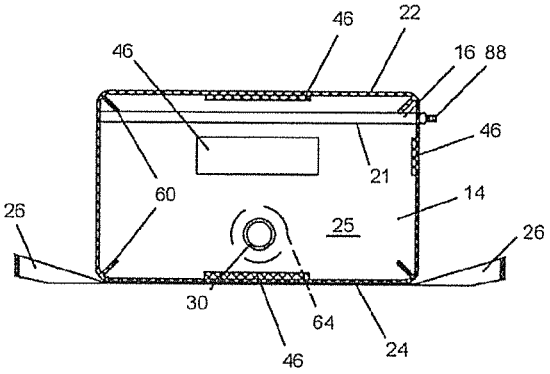
FIGS. 3 and 4 are sectional views of the apparatus of FIG. 1
Figure 4:
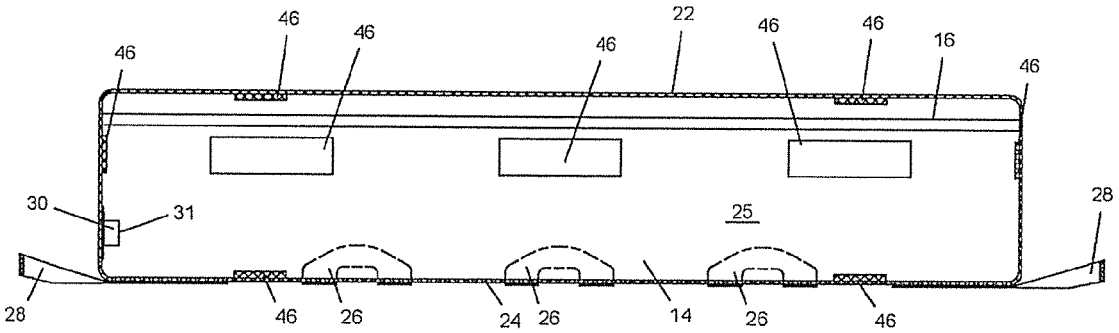

The flexible panels are welded to each other at seams 60 shown in FIG. 3. Seams 60 can be formed of any suitable weld, adhesive, seal and/or other apparatus or device or method that provides a gas tight and/or liquid tight seal between the two or more materials. In one embodiment, the apparatus 10 desirably has an exterior plastic shell that is welded in such a fashion that there are no cracks, crevices, pockets or other voids, such as formed by overlapping material on the outer seams thereby facilitating decontamination of the outer shell of the apparatus by allowing a decontamination agent to access and, for example, flush or otherwise rid or remove the contaminated material from within any such void.

Figure 5:
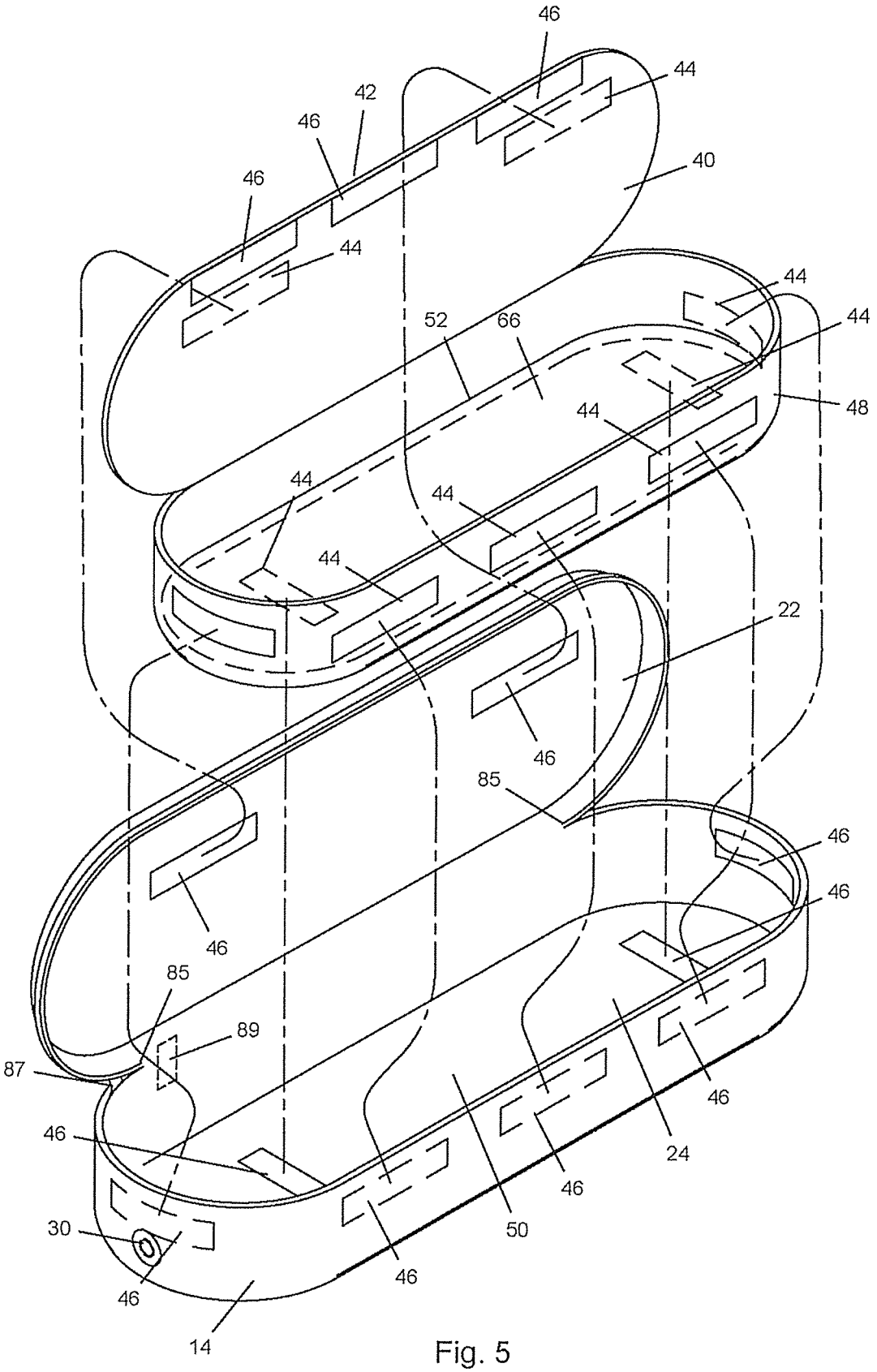
FIG. 5 shows a perspective view of the apparatus of this invention, in an open state, with an exploded view of the interior liner and the exterior enclosure of the apparatus of FIG. 1.

The enclosure 12 defines a transport chamber 25 that is capable of receiving a contaminated object or person. Access to the transport chamber 25 is provided by a closable opening 21. In order to provide a gas and liquid tight enclosure 12, the closable opening 21 is provided with a gas tight and/or liquid tight fastener 16 for closing the closable opening. The closable opening 21 extends adjacent, but not necessarily in contact with, a portion of a periphery of the top panel 22. As seen in FIG. 5, the closable opening 21 is formed in the side panel. However, the closable opening can be formed at or in line with the seam between the top panel 22 and side panel 14.

As mentioned above, the panels of the enclosure 12 are desirably formed of a flexible material. The flexible material can be any material, and desirably includes a plastic film to provide the intended containment. One preferred exterior fabric or material for this enclosure 12 is an opaque, flexible, fiber-reinforced plastic film, such as a 30 mil (0.030 inch) polyurethane (PU) or polyvinylchloride (PVC) (or any other suitable weldable plastic) coated nylon webbing. In one embodiment of this invention, the fiber reinforced plastic film is a laminate having one or more fabrics or web materials disposed between at least two film layers. One manufacturer of a suitable exterior material is Phoenix Films, Inc., in Clearwater, Fla.

The enclosure 12 includes an exhaust port 30 that has a first end 31 within the transport chamber 25 and a second end 32 that is opposite the first end 31. The second end is desirably external of the transport chamber 25. At least one of the first end 31 and the second end 32 receives a fitting for securing a filter thereto, as will be described further below with reference to FIGS. 10 and 11.

In the embodiment of FIGS. 1-4, the bottom panel 24 includes or has welded to it one or more pairs of lateral reinforcing straps 26. The straps can be formed from the same or different material than the flexible panels, such as PU or PVC coated nylon webbing. For the purposes of some embodiments of this invention, "lateral" means straps that are generally perpendicular to the main axis of the apparatus 10. The straps 26, which are secured to the outside of the bottom panel 24, serve as supplemental structure for reinforcing the bottom panel 24. The straps 26 are desirably applied to the outside of the bottom panel 24 by a weld that seals around at least the entire edge of the contact area of the strap 26, thereby reducing or mostly eliminating any crevice or pocket between the straps 26 and the bottom panel 24, so as to minimize any collection area for contaminants.

As may be seen in FIGS. 1-4, the lateral ends of each reinforcing strap 26 can form handhold loops. The isolation apparatus 10 and the remains or equipment within may be lifted and transported by individuals or other transporters placing hands in the handholds 26. In addition, as may be seen in FIG. 1, handholds 28 may be provided at the foot end 18 and the head end 20 of the apparatus 10. The handholds 28 are generally formed in the same manner and can be made, for example, of the same coated nylon webbing material as the lateral reinforcing straps 26.

The interior of the enclosure 12 of the apparatus 10 can have hook fasteners 46 welded or otherwise fastened to the interior surface of the top panel 22, the interior surface of the side panel 14, and/or the interior surface of the bottom panel 24 for attachment of an interior liner, as shown in FIG. 5.

The interior liner in FIG. 5 is shown as shroud 40, having a general size and configuration to correspondingly match the interior surface of the enclosure 12. The shroud 40 is desirably formed of a chemical absorptive and/or barrier material. In the embodiment shown in FIG. 5, the shroud 40 has a bottom panel 52, a side panel 48, and a top panel 42, that are sewn or otherwise secured together and that correspond to the panels of the enclosure 12. The outside of the top panel 42 of the shroud 40 has loop fasteners 44 that are fastened to the hook fasteners 46 on the interior side of the enclosure top panel 22. The outside of the side panel 48 of the shroud 48 has loop fasteners 44 that are fastened to the hook fasteners 46 on the interior side of the enclosure side panel 14. The outside of the bottom panel 52 of the shroud 40 also has loop fasteners 44 that are fastened to the hook fasteners 46 on the interior side of the enclosure bottom panel 24.

When remains or equipment are placed into the containment bag of the apparatus 10, the top panel 42 of the shroud 40 can be detached from the fasteners 46 and used to cover the remains or equipment. The closable opening 21 of the enclosure 12 can then be closed to create a gas tight and/or liquid tight heavy duty exterior shell. The interior shroud 40 functions to adsorb, absorb, and/or react with one or more chemical agents from the chemically contaminated equipment or remains that may otherwise degrade the plastic enclosure over time. This interior shroud 40 allows the isolation apparatus 10 to be used for extended periods of time, such as in chemical warfare environments.

The liner or shroud 40 is desirably made of chemical adsorptive or absorptive material, such as a chemical adsorptive barrier fabric. Suitable materials for forming the liner or shroud 40 include materials incorporating carbon sphere or activated charcoal material technology. Such materials are commonly used in chemical protective suits. A particularly preferred material is a carbon sphere technology fabric available under the trade name SARATOGA by Blucher GmbH (Düsseldorf, Germany). SARATOGA fabric is described by the manufacturer as a composite filter fabric based on highly activated and hard carbon spheres fixed onto textile carrier fabrics. Other exemplary activated charcoal and/or carbon sphere materials are manufactured by Gentex Corporation (Simpson, Pa.) under the trade name LIFETEX. Further, an absorptive mat 66 can optionally be included with or sewn to the bottom panel 52 of the shroud 40, to provide additional absorption of fluids or other material within the transport chamber 25.

Figure 6A:
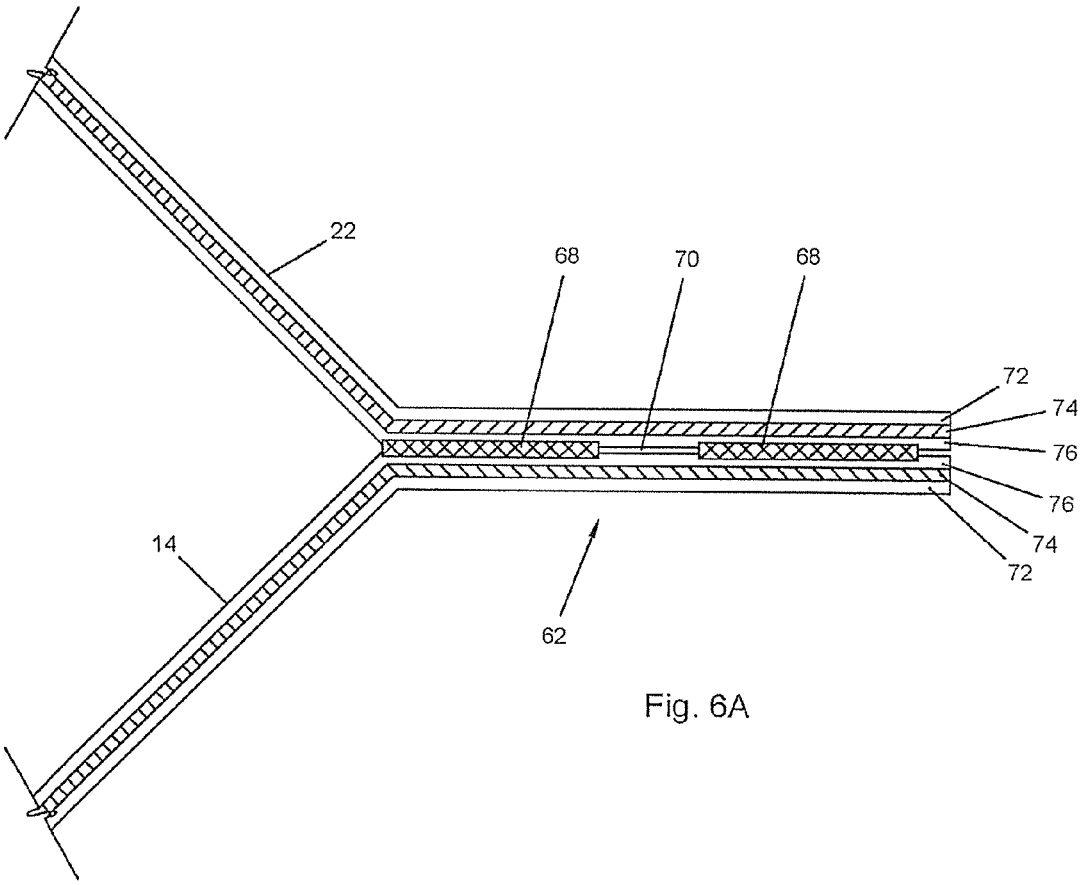
FIGS. 6A-B show a seam according to one embodiment of this invention.
Figure 6B:
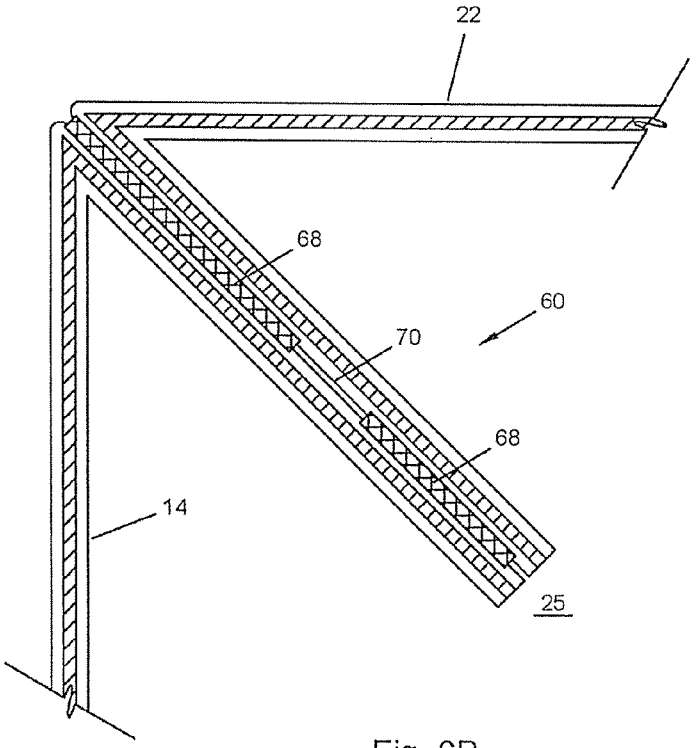

FIG. 6A-B illustrate a seam 60 according to one embodiment of this invention. FIG. 6B illustrates the formation of the seam 60 between the top panel 22 and the side panel 14, but the construction can be repeated at other seams between other components. FIG. 6A shows the top panel 22 and the side panel 14 in a configuration for creating the welds of seam 60. Each of top panel 22 and side panel 14 includes a web 74 disposed between two plastic film layers 72 and 76. The connection at seam 60 is formed by two welds 68. The welds 68 can be formed by any suitable method, such as radio frequency (RF) welding, to partially melt the layers 76 together. The particular configuration of two welds 68 and a weld spacing 70 therebetween is particularly beneficial in case one weld 68 is compromised.

FIG. 6B illustrates the folding of the top panel 22 and side panel 14 into the final position, thereby placing the seam 60 within the transport chamber 25. In one embodiment of this invention, all ends of a panel are disposed either within the enclosure 12 or outside of the enclosure 12. In this way, contaminants within the chamber cannot wick through the fibrous reinforcement layers from inside of the enclosure 12 to outside of the enclosure 12.

FIG. 7 illustrates a sectional view of the connection of the two ends of the side panel 14. The two ends of the side panel 14 meet at seam 84. A weld panel 82 is welded over the seam 84 using more than one weld, and, more particularly, three welds 68. As shown in FIG. 7, the welds 68 desirably contact the ends of the weld panel 82, thereby not providing a crevice between the weld panel 82 and the side panel 14 that could hold contaminants from a contaminated site.

Figure 8:
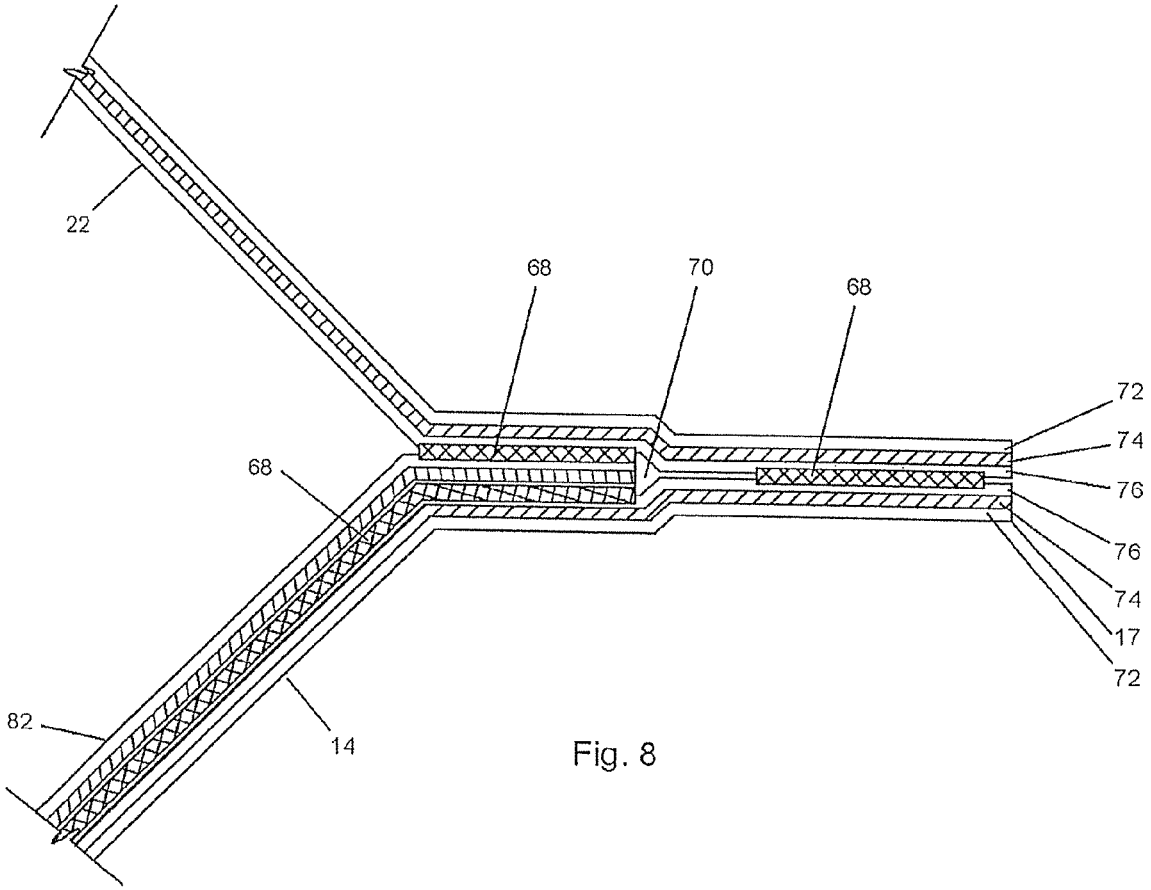
FIG. 8 shows a further side wall seam according to one embodiment of this invention.

FIG. 8 illustrates the connection of the top panel 22 with the side panel 14 in the area of the weld panel 82. As can be seen in FIGS. 7 and 8, the weld panel 82 does not extend to the end 17 of the side panel 14. In this embodiment, as shown in FIG. 8, a portion of the weld panel 82 is welded between the top panel 22 and the side panel 14, and the top panel 22 and the side panel 14 are welded directly together in an area (over seam 84) at the end of the weld panel 82.

Figure 9:
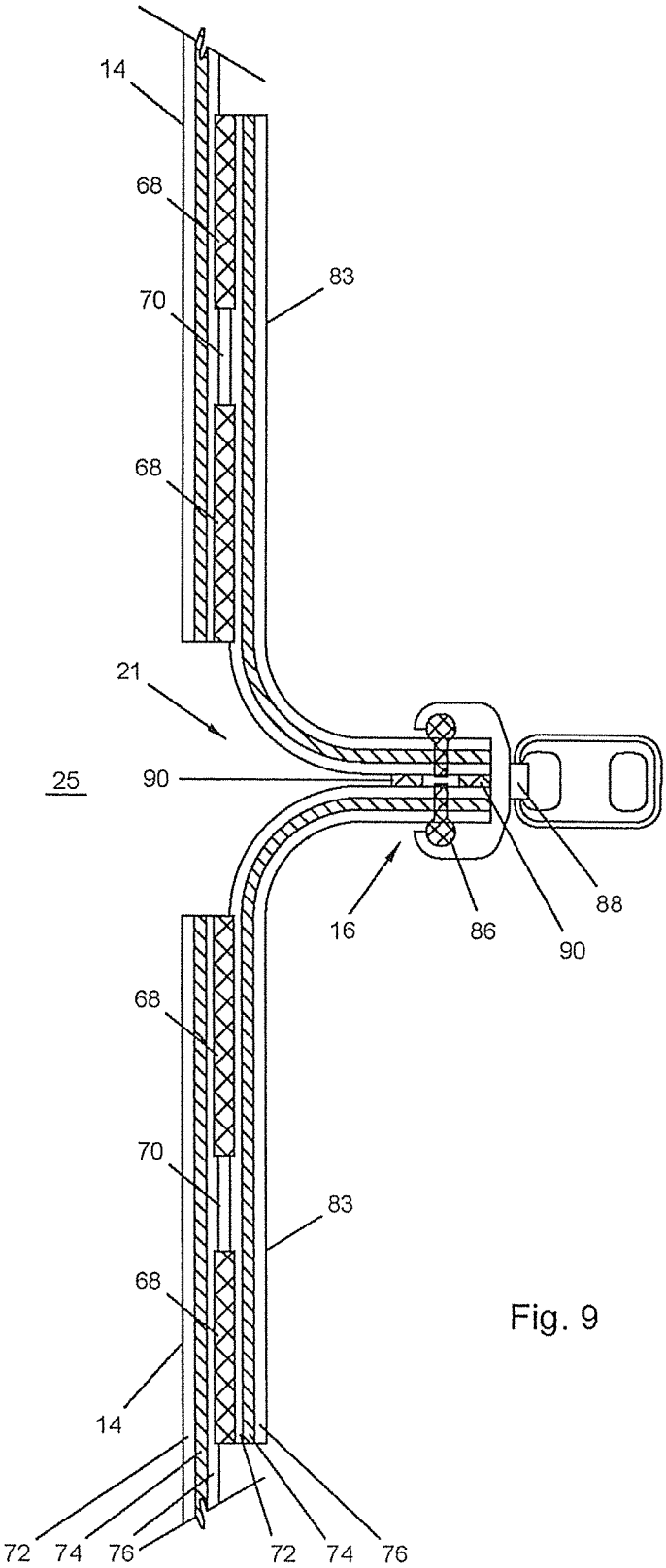
FIG. 9 shows the attachment of a zipper according to one embodiment of this invention.

FIG. 9 illustrates the connection of the gas tight and/or liquid tight fastener 16 to the side panel 14. In one embodiment of this invention, the gas tight and/or liquid tight fastener 16 comprises a slider assembly, such as zipper 88. The zipper 88 includes a zipper chain 86 extending between two opposing end stops 85 (shown in FIG. 5). At each end stop 85, the two chain tape components 83 that form the chain 86 are secured together by welds 90. An optional zipper reinforcement member 87, such as a strip of the fiber/plastic laminate discussed above, can be attached over the zipper chain in an area adjacent to at least one of the end stops 85 to keep the end stop 85 from ripping or otherwise separating during use. Each of the two chain tape components 83 are welded by two welds 68 to the side panel 14 on one side of the access opening 21.

One suitable type of zipper 88 that can be used to prevent air or liquid contaminant passage between the inside and the outside of the apparatus is known as a pressure sealed zipper. Such zippers are available from YKK, Corporation, 1, Kandaizumi-cho, Chiyoda-ku, Tokyo, 101-8642, Japan. As may be seen in FIG. 1, the zipper 88 is adhered and/or secured to, and the apparatus 10 opens along: (i) one lengthwise side of the apparatus 10; and (ii) the two opposite ends 18 and 20 of the apparatus 10. It is not secured to the opposite lengthwise side of the apparatus 10. Essentially, the zipper 88 can extend along three of the four sides of the apparatus 10. Accordingly, the zipper 88 can be opened to either place remains or equipment within or remove a remains or equipment from the apparatus 10. The apparatus 10 opens along a hinge formed by the opposite (non-zipper) side. As a result, the apparatus 10 can open like a clamshell or a suitcase. This suitcase-type opening of the apparatus 10 enables the content to be easily loaded and removed.

A locking strap 89, for example, made from the same plastic laminate material as the exterior shell of the apparatus 10, is welded onto the exterior of the enclosure 12. The locking strap 89 is spot welded at its two ends to form a loop. An optional tie (e.g., wire, cable, or zip tie) can be passed through the loop and the zipper handle assembly and tightened to lock the zipper 88 in its closed state.

Figure 10:
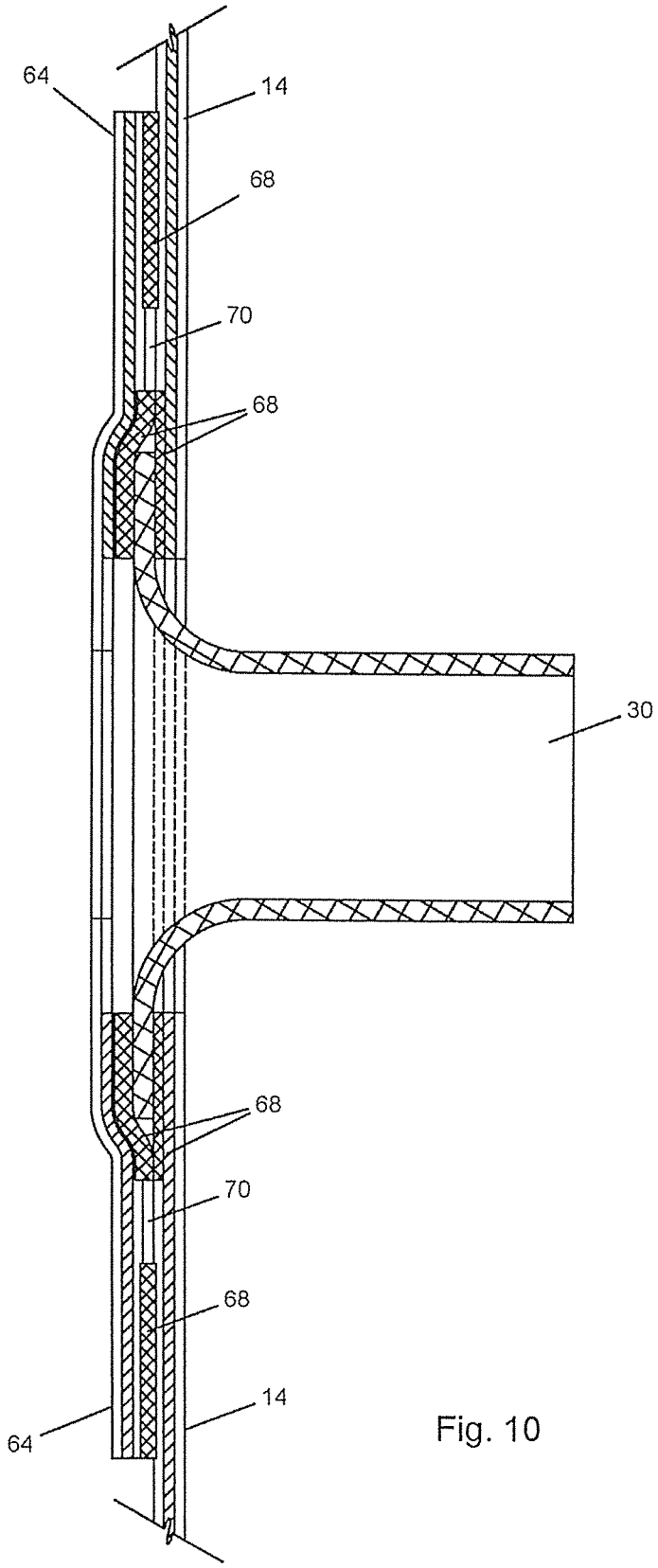
FIG. 10 shows a cross-section of a tube sealed to bag material, forming an exhaust port.

FIG. 10 is a sectional view of the attachment of the exhaust port 30. The foot-end 18 of the apparatus 10 includes the exhaust port 30, which comprises a PU and/or PVC (for example) tube welded to the side panel 14. The end of the exhaust port tube 30 that is external of the transport chamber 25 is welded to the outside of the side panel 14 between the side panel 14 and a port panel 64.

Figure 11:
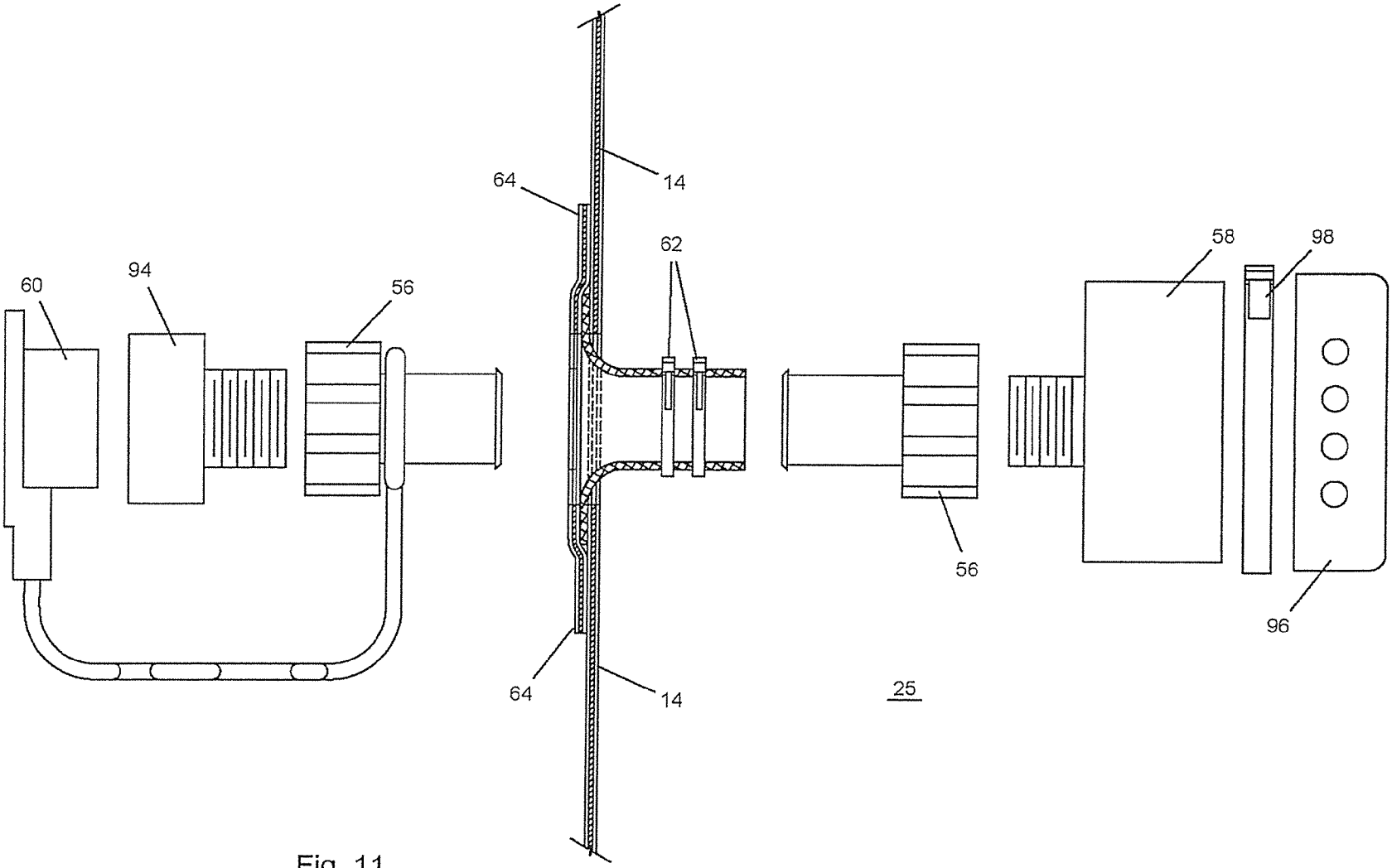
FIG. 11 shows an attachment of a filter to the exhaust port of FIG. 10.

FIG. 11 illustrates an exploded view of a filter fitting for the exhaust port 30. Two plastic female thread fittings 56 are clamped within the port 30 by clamps 62. An optional tape, such as a self-sealing silicone tape can be placed over the clamps 62 once clamped. A filter 58 can be screwed into the fittings 56 on one or both sides of the port 30. Filter 58 can be an NBC or CBRN filter, such as those available from SafetyTech International, Inc. (Frederick, Md.). Desirably, the filter 58 is at least applied to the inside fitting 58. A second filter 58 disposed on the external fitting 56 can be used to ensure the desired release properties are sustained even if the inside filter 58 has become wet. The filter 58 allows for release of pressure from within the bag, for example that may result from decomposition gas buildup or from aircraft decompression, while preventing or blocking the escape of the contaminating agent. A tethered cap 60 can be used to cover the external filter fitting 56, such as during a decontamination method.

An optional check valve 94 can be included between the external fitting 56 and any filter 58, thereby ensuring no decontamination fluid is able to enter the transport chamber 25, such as if and when the apparatus 10 is dipped in such decontamination fluid. An optional diffuser cap 96 can also be added to one of the filters 58 to direct the filtered gas in one or more directions for an external filter 58 or limit direct contact on an internal filter 58 with fluid within the transport chamber 25, such as when the bag is picked up at end 20. The diffuser cap 96 preferably includes radial openings, and can be attached to the filter 58 by any means, such as clamp 98 or a threaded attachment.

Thus, the invention provides an isolation apparatus that when closed is completely air sealed and liquid sealed. Particularly, the generally reinforced plastic enclosure can be impervious to the surroundings, and can prevent contaminants from leaving or entering the apparatus. Specific embodiments have been illustrated and described. There are other possible modifications, such as sizes, shapes, and configurations of the panels, other components, and connections between components, without significantly departing from the spirit of this invention. Any component or element or method discussed in this specification, can be used in combination with or substituted with any component or element or method which may have a similar function and/or which may produce a similar result.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An isolation apparatus for transporting a contaminated object or contaminated human remains, comprising:

an opaque enclosure sealed against releasing chemical, biological, and radiological agents, and including a plurality of gas and liquid tight flexible panels each formed of a laminate including a fabric or web material between at least two film layers and sealed by gas tight and liquid tight seams, and defining a transport chamber for receiving the contaminated object or contaminated human remains, and a closable opening providing access to the transport chamber;

each of the flexible panels having one or more peripheral ends, wherein for each panel the corresponding one or more peripheral ends are disposed either: all within the transport chamber, or all outside the transport chamber, whereby contaminants cannot wick through the fabric or web material from inside the transport chamber to outside the enclosure;

a gas tight and liquid tight fastener closing the closable opening; and a removable interior liner disposed within the transport chamber and adapted to surround and cover the contaminated object or contaminated human remains, the interior liner comprising a carbon containing fabric that provides a chemical protective barrier between the contaminated object or contaminated human remains and at least a portion of the enclosure.

2. The isolation apparatus of claim 1, wherein two outside surfaces of the flexible panels are connected together by a weld, and the two flexible panels are folded about the weld to place the corresponding peripheral end of each of the two panels within the transport chamber.

3. The isolation apparatus of claim 1, wherein the chemical protective barrier contains carbon spheres or activated charcoal thereon.

4. The isolation apparatus of claim 1, wherein the enclosure is gas tight and liquid tight and further comprises a filtered exhaust port in combination with the enclosure for reducing pressure within the transport chamber.

5. The isolation apparatus of claim 4, wherein the exhaust port includes a first end within the transport chamber and a second end opposite the first end and external of the transport chamber, at least one of the first end and the second end having a fitting for securing a filter thereto, the fitting including a check valve.

6. The isolation apparatus of claim 5, further comprising at least one CBRN or NBC filter connectable to at least one of the first end or the second end of the exhaust port.

7. The isolation apparatus of claim 1, wherein the plurality of flexible panels comprises a bottom panel, a side panel, and a top panel, a bottom end of the side panel is welded by a weld about a periphery of the bottom panel, at least a portion of the top panel is welded by a weld to at least a portion of the side panel, and the closable opening extends adjacent a portion of a periphery of the top panel.

8. The isolation apparatus of claim 7, wherein the flexible panels are folded about the weld to place the corresponding peripheral ends within the transport chamber.

9. The isolation apparatus of claim 7, wherein the one or more peripheral ends of the side panel comprises two opposing ends that meet at a seam, and further comprising a weld panel welded over the seam, and an end portion of the weld panel is welded between the side panel and the top panel.

10. The isolation apparatus of claim 9, wherein the side panel comprises two side ends extending between the two opposing ends, the weld panel includes a weld panel end that stops short of one of the two side ends, and the top panel and the side panel are welded directly over the seam at an end of the weld panel.

11. The isolation apparatus of claim 7, wherein the liner comprises a shroud adapted to surround the contaminated object or contaminated human remains, the shroud including a bottom shroud panel, a side shroud panel connected about a periphery of the bottom shroud panel, and a top shroud panel having a portion connected to a portion of the side shroud panel.

12. The isolation apparatus of claim 7, further comprising:

a strap attached to an outside surface of the bottom panel of the enclosure; and a strap weld that seals around at least the entire edge of a contact area between the strap and the bottom panel.

13. The isolation apparatus of claim 1, wherein the gas tight and liquid tight fastener comprises a pressure sealed zipper.

14. The isolation apparatus of claim 13, further comprising a locking strap attached to an exterior of the enclosure at an end of the gas tight and liquid tight fastener for securing the fastener in a closed position.

15. The isolation apparatus of claim 13, wherein the zipper comprises a zipper chain extending between two opposing end stops, and further comprising a zipper reinforcement member attached over the zipper chain in an area adjacent to at least one of the opposing end stops.

16. An isolation apparatus for transporting a contaminated object or contaminated human remains, comprising:

a flexible enclosure defining a transport chamber sealed against releasing chemical, biological, and radiological agents and for receiving the contaminated object or contaminated human remains, the enclosure comprising flexible panels connected by welds, the flexible panels including a bottom panel, a side panel welded about a periphery of the bottom panel, and a top panel having a portion welded to a portion of the side panel, the side panel including a closable opening providing access to the transport chamber, and each of the flexible panels formed of an opaque laminate having one or more fabrics or web materials disposed between at least two plastic film layers;

each of the welds welding one of the at least two plastic film layers of one of the flexible panels to one of the at least two plastic film layers of an other of the flexible panels;

each of the flexible panels having at least one corresponding peripheral edge, wherein for each panel the corresponding at least one peripheral edge is disposed either: all within the transport chamber, or all outside the transport chamber, whereby contaminants cannot wick through any of the one or more fabrics or web materials of the each of the flexible panels from inside the transport chamber to outside of the flexible enclosure;

a gas tight and liquid tight slider assembly in combination with the closable opening;

an exhaust port for venting pressure within the transport chamber, the exhaust port including a first end within the transport chamber and a second end opposite the first end and external of the transport chamber, each of the first end and second ends having a fitting to secure a chemical, biological, and radiological agent filter thereto; and a removable interior liner disposed within the transport chamber and adapted to surround and cover all sides of the contaminated object or contaminated human remains, the interior liner comprising a chemical adsorptive or absorptive fabric that provides a chemical protective barrier between the contaminated object or contaminated human remains and at least a portion of the enclosure, the chemical protective barrier including carbon spheres or activated charcoal.

17. The isolation apparatus of claim 16, wherein the liner comprises a shroud adapted to surround the contaminated object or contaminated human remains, the shroud including a bottom shroud panel, a side shroud panel connected about a periphery of the bottom shroud panel, and a top shroud panel having a portion connected to a portion of the side shroud panel, and each of the bottom shroud panel, the side shroud panel, and the top shroud panel is removably secured by a fastener to a corresponding one of the bottom panel, the side panel, or the top panel of the enclosure.

18. The isolation apparatus of claim 16, wherein at each of the welds the flexible panels are folded about the weld to place the corresponding peripheral ends of the welded flexible panels disposed within the transport chamber.

19. The isolation apparatus of claim 16, wherein the one or more peripheral ends of the side panel comprises two opposing ends that meet at a seam, and further comprising a weld panel welded over the seam, and an end portion of the weld panel is welded between the side panel and the top panel.

20. The isolation apparatus of claim 19, wherein the side panel comprises two side ends extending between the two opposing ends, the weld panel includes a weld panel end that stops short of one of the two side ends, and the top panel and the side panel are welded directly over the seam beyond an end of the weld panel.

* * * * *